United States Patent [19]

Clark et al.

[11] 4,136,991

[45] Jan. 30, 1979

[54] ROADWAY MARKER AND PROCESS OF AND APPLICATION FOR PRODUCING THE SAME

[75] Inventors: Elin R. Clark; Benny J. Clark, both of Rte. 1, Box 219F, Lindale, Tex. 75771; Jerry M. Lang, Lindale, Tex.

[73] Assignees: Elin R. Clark; Benny J. Clark, both of Lindale, Tex.

[21] Appl. No.: 802,817

[22] Filed: Jun. 2, 1977

[51] Int. Cl.[2] ..... E01F 9/04

[52] U.S. Cl. ..... 404/73; 404/94; 404/15

[58] Field of Search ..... 404/94, 15, 72, 101, 404/108, 73, 93, 99, 73, 83

[56] References Cited

U.S. PATENT DOCUMENTS

| | | | |
|---|---|---|---|
| 2,187,879 | 1/1940 | Johnson | 404/72 |
| 3,086,431 | 4/1963 | Perry | 404/94 |
| 3,114,597 | 12/1963 | Lee | 404/15 X |
| 3,590,701 | 7/1971 | Broeck | 404/94 X |

*Primary Examiner*—Nile C. Byers, Jr.
*Attorney, Agent, or Firm*—Newton, Hopkins & Ormsby

[57] ABSTRACT

A raised marker is produced by inserting molten resin material, which has been premixed with a hardner or catalyst, into an open mold so that the resin conforms to the shape of the mold. The mold, prior to the time the resin cures or sets up, is inverted and placed on the pavement so that the resin, itself bonds to the pavement surface. The mold may be removed or remains as a permanent shell for the marker. A parting agent is used when the mold is to be removed. Color pigments and-/or inserts in the form of glass beads or other reflective elements may be incorporated in the resin. Mechanism is shown for automatically filling and depositing the molds.

12 Claims, 5 Drawing Figures

ROADWAY MARKER AND PROCESS OF AND APPLICATION FOR PRODUCING THE SAME

BACKGROUND OF THE INVENTION

1. Field of the Invention

This invention relates to route markers and process of and apparatus for producing the same, and is more particularly concerned with raised highway roadmarkers of the type used to designate a prescribed lane of traffic and to a process of and apparatus for producing and installing such markers on the road surface.

2. Description of the Prior Art

In the past, raised road markers have been widely used. These markers have been in the form of "buttons", "jiggle bars" and other raised members adhered or otherwise affixed to the pavement. The markers, themselves, have been of clay, metal (aluminum and stainless steel), ceramic, and plastic (poly eurathane and polyethylene).

The following U.S. Pat. Nos. illustrate prior art markers: 2,371,462; 3,332,327 and 3,938,903. Of the above patents, U.S. Pat. No. 3,096,694 discloses the use of a two part epoxy resin for bonding the bottom surface of the marker to the roadway.

All marking devices now used, to the best of our knowledge are manufactured away from the site of the installation and subsequently installed by applying adhesive, such as an epoxy glue, to the bottom surface of the marking device. Then, the marking device is placed on the roadway surface so that the glue is sandwiched between the marking device and the surface. If properly installed, the marking device, when the adhesive drys or cures, is quite firmly held in place. Such marking devices, however, are bulky and expensive, and at time pull off, leaving the adhesive on the surface. This is perhaps due to a difference in coefficient of expansion between the "button" and the glue, which tends to loosen the button with changes in temperature. We cast the marking device or marker on the site and apply it to the surface while the resin is setting up. Thus, the material from which the marker is made, integrally bonds the marker to the surface.

The prior art markers usually cost about two and one half times as much to purchase and install as our markers cost installed.

SUMMARY OF THE INVENTION

Briefly described, the present invention includes the steps of mixing together a resin and a hardner or catalyst on the site so as to provide a pliable or molten mass of the consistency of grease which is then cast into an open mold of the desired shape to form a raised marker. While the resin is still pliable or tacky, but has set up sufficiently to retain the general shape of the mold, the mold is inverted and placed onto the pavement (roadway) so that the resin integrally bonds this raised marker in place on the roadway.

After the resin has cured sufficiently for the marker to retain its shape, the mold is removed.

The procedure of the present invention provides a resulting raised marker which is quite firmly secured in place, even when the pavement has substantial irregularities. The installation is less time consuming and less expensive than prior art procedures. No large inventories of markers is necessary.

If desired, the mold may remain with the resin so as to form the upper surface of the marker.

Glass beads and/or pigments can be incorporated in the resin.

The machinery for successively producing the markers and for installing them at spaced prescribed intervals includes a roadway vehicle which carries a magazine or hopper containing the molds or shells. The hopper drops the molds, one at a time, onto a continuous conveyor which then carries the molds successively beneath a filling nozzle where prescribed amounts of resin are deposited in the respective molds. Hooks or retaining means on the conveyor receive the molds and flip or invert the molds as they are discharged onto the roadway in an inverted position. A presser member then passes over the mold and urges it against the roadway.

If the mold is to be removed, a releasing agent is sprayed into the mold before it receives the resin.

DESCRIPTION OF THE PREFERRED EMBODIMENTS

Figure 4:
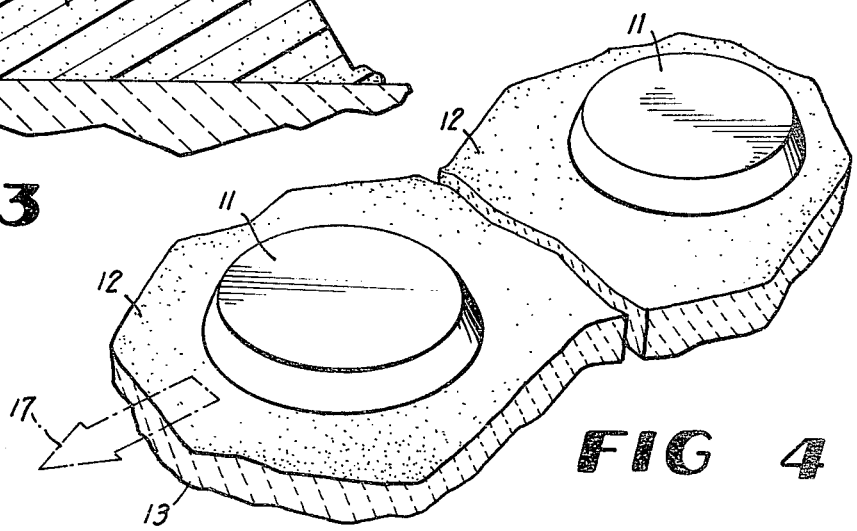
FIG. 4 is a fragmentary view of a portion of the roadway, receiving the raised markers thus formed.

The present invention includes the steps of successively filling successive individual upwardly open, cup shaped, circular mold 10 with a plastic mixture of resin and a hardner or catalyst to form a cast raised marker 11. While the resin is still in its molten or tacky condition, having the consistency of heavy grease, the mold 10 is inverted onto the surface 12 of the roadway of pavement 13 forming a highway, street or parking lot. When the raised marker 11, thus formed, has hardened or cured sufficiently, the mold 10 may be removed, leaving the marker 11, in place on surface 12. The procedure is then repeated so that successive raised markers 11 are installed at prescribed spaced intervals along the roadway surface 12 as illustrated in FIG. 4.

Figure 1:
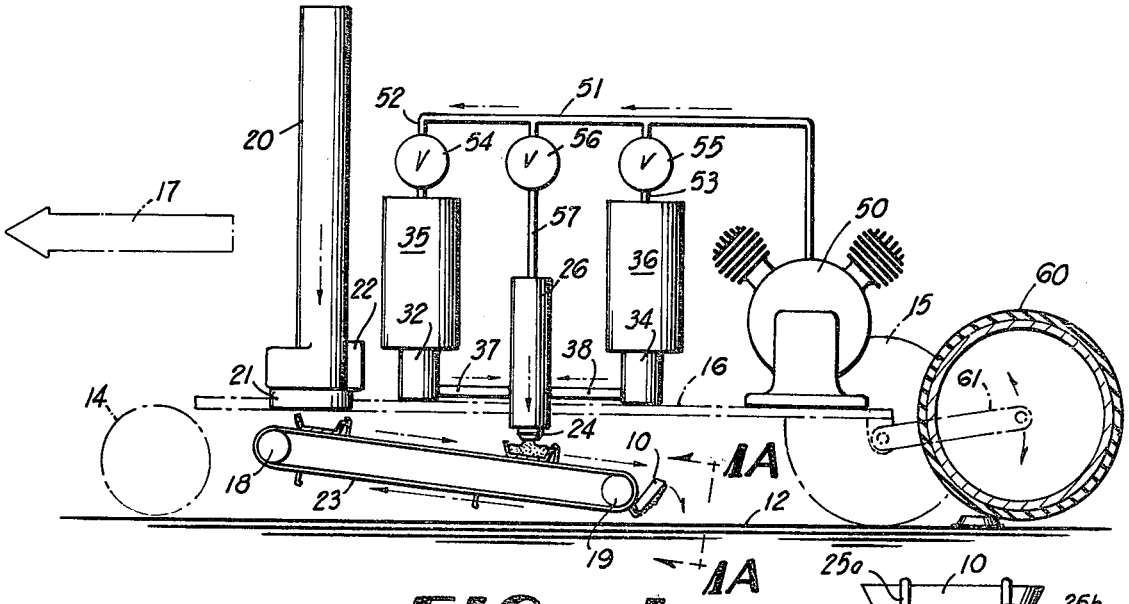
FIG. 1 is a schematic diagram of a marker laying machine constructed in accordance with the present invention, the machine filling molds with plastic and depositing them on a surface in accordance with the method of the present invention.
Figure 1A:
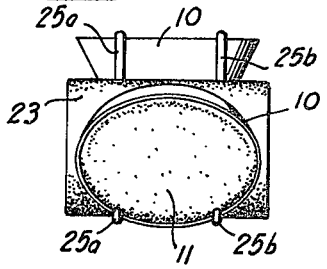
FIG. 1A is an enlarged sectional view taken substantially along line 1A—1A in FIG. 1.
Figure 2:
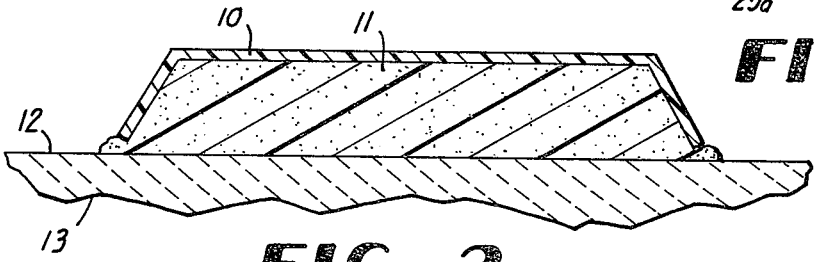
FIG. 2 is a vertical sectional view of an inverted mold as installed on a roadway by the machine of FIG. 1 and using the method of the present invention.
Figure 3:
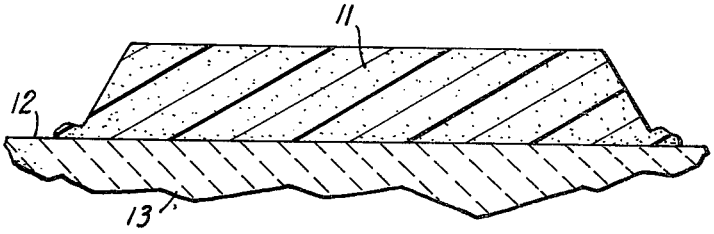
FIG. 3 is a vertical sectional view of the resulting raised marker in place on the roadway after the mold has been removed.

While many specific procedures may be devised for automating a portion or all of the above procedure, the markers 11 may be automatically and successively produced and installed by the machine of FIG. 1.

The machine of FIG. 1 is mounted on a suitable wheeled vehicle, the front and back wheels of which are denoted generally by numerals 14 and 15. The vehicle is moved over roadway 12 in the direction of arrow 17. The vehicle carries a horizontal platform 16 and a pair of transverse conveyor rollers 18 and 19, below the platform 16.

Mounted on the platform 16, toward the front of the machine, is an upright tubular magazine or mold dispensing hopper 20 in which the molds 10 are stacked. A solenoid control member 21 controls the dispensing of the molds 10, one at a time and controls the spraying of a parting or release agent from a reservoir 22 onto the surface of the mold 10 after the mold 19 has been dropped. Mechanisms for dispensing cup-like members, such as molds 10, are well known in the dispensing art.

Below the magazine 20 in a position to receive each dropped mold is a rearwardly and downwardly inclined conveyor belt 23, carried by rollers 18 and 19. The molds 10 are successively dropped upon the rearwardly and downwardly slightly inclined upper flight of conveyor 23 and pass, gradually rearwardly and downwardly.

The conveyor 23 thus transports the molds 10 successively beneath a spout 24 of a mixing head or blender 26 on platform 16 where a measured amount of the mixed resin is deposited into and fills each mold 10. The resin is a pliable tacky molten plastic mass of the consistency of grease. It spreads out and clings to the inside of the mold after being received.

Thence, the conveyor 23 passes around the rear roller 19, roller 19 being disposed adjacent to the surface 12. It will be observed that the conveyor 23, forwardly adjacent the position of receiving each mold 10, in the travel of the conveyor 23, is provide with a pair of spaced, outwardly protruding inverted, L-shaped fingers or hooks *25a, 25b*. The bent ends of fingers *25a, 25b* stand slightly above the rim of mold 10. When the mold 10 is passed around roller 19, it slides forwardly, i.e. downwardly, on conveyor 23 and is received on and engaged by the fingers *25a, 25b* sufficiently for the mold 10 to be held and then everted or inverted so as to fall in this inverted condition onto surface 12. Due to its tackiness, the resin remains in the mold as it is inverted, even when a releasing agent is employed.

For supplying the mixed resin or plastic to mixer or blender 26, two separate resin tanks 35 and 36 are provided. Heaters 33 and 34 heat the resin. Part A of a resin is supplied to one tank 35 and part B of the resin, to the other tank 36. Conduits 37 and 38, connected between the tanks 35 and 36 mixer 26, supply the increments of resin from tanks 35, 36 to the mixer 26. Air pressure for moving the resin parts is supplied to the tanks 35 and 36 by compressor 50 via air lines 51, 52 and 53 and valves 54 and 55. Air pressure for driving the air motor of mixer 26 is supplied via valve 56 and conduit 57.

Rearwardly of the roller 19 of the conveyor, the vehicle is provided with a tamping roller 60 which passes over each inverted mold 10 on surface 12 so as to tamp or force the mold 10 down toward surface 12 and, therefore, the resin of the marker 11 down and into the surface 12. This also tends to expell any air from the fluid resin mass, prior to the time the resin sets up. The roller 60 is pivotally mounted by pivot arms 61 to the rear portion of platform 16.

After the resin has set up, the mold 10 is removed to leave the marker in place.

Each mold 10 is a thin wall plastic (nylon) circular cup-shaped member open at its top and nestible with each other. Any other shape mold could be used, as desired. The molds are vacuum formed or injection molded. In applications where the mold will be retrieved, a release or parting agent, such as silicon spray, light oil or any lubricant, should be used to coat the interior of each mold 10, prior to the time the resin is received by the mold 10.

The resin which we prefer to use is a two part epoxy resin, such as epoxy type 1 or type 2 produced by Industrial Coating, Inc. of Houston Texas. Types 1, 2, 3 or 4 epoxy resin produced by Andrew Brown division of Kennecott Copper of Ervin Texas are also suitable resins.

Cement patching material or other adhesive resin can be substituted for the epoxy here disclosed. The resin has the consistency of heavy grease and usually sets up within two hours and provides a raised mark which is water resistant and has a Brunnell hardness of from about 40 to about 90.

The marking devices, thus produced and installed, permit uniform expansion and contraction and should last as long as the surface, itself, lasts. The hardness can exceed the hardness of ceramic buttons.

Using the present invention, low profile buttons or marking devices are readily produced so that a snow plow can pass over these buttons.

Color pigments of any color can be incorporated into the resin before it is cured. Also, glass beads and other reflective surfaces can be embedded in the resin before it cures.

The mold 10 can be an injection molded plastic member or a metal member which is bonded to and remains with the resin or, when the interior of the mold is coated with a release agent, can be removed from the resin after it has cured.

The markers or marking devices 11 of the present invention can be used to outline traffic lanes for highways and even in factories. They are also useful in outlining runways, taxi ways and parking slots.

The marker or marking device 11 is, when set up, a monolithic plastic structure, a lower portion of which has increments intermingled with the intersticies of the roadway 13 at the interface formed at surface 12. It stand well above the surface 2.

We claim:

1. Process of producing a roadway marker comprising:

(a) disposing an upwardly open mold of a roadway marker in a position adjacent to a roadway;

(b) filling said mold with a plastic which will set up after being placed in the mold;

(c) inverting the mold containing the plastic onto a roadway surface for depositing said plastic and said mold onto the roadway surface, while said plastic is in a fluid condition and is still within said mold, so that the plastic will adhere to said surface; and (d) permitting said plastic to set up while maintaining the shape of said plastic as imparted by said mold so that a monolithic plastic structure is produced adhered by its lower portion to the surface of said roadway.

2. The process defined in claim 1 wherein said mold is disposed over said surface and protrudes thereabove, whereby the resulting monolithic plastic structure extends above the surface of the roadway.

3. The process defined in claim 1 including a step of urging the mold with the plastic onto said roadway and leaving the mold with the plastic until the plastic has set up, whereby the mold forms the exterior of the roadway marker.

4. The process defined in claim 1 wherein said mold is urged with said plastic onto the roadway surface and the mold is thereafter removed from the plastic after the plastic has set up.

5. The process defined in claim 1 wherein said plastic is an epoxy resin admixed with a catalyst and said epoxy resin is in a molten condition when it is filled into said mold.

6. The process defined in claim 5 wherein said mold is coated with a releasing agent, prior to the time that the plastic is filled into said mold and said mold is removed from the plastic after the plastic has set up on said surface.

7. The process defined in claim 1 wherein said mold is coated along its interior surface with a releasing agent, prior to the time that said mold is filled with plastic.

8. A machine for producing and installing roadway markers comprising a vehicle, a mold hopper disposed on said vehicle for receiving open molds, a conveyor disposed adjacent to said hopper for receiving successive of said molds discharged from said hopper and for supporting and transporting said molds in an upright condition, means associated with said conveyor for inverting and releasing the molds successively in their inverted positions from said conveyor onto a roadway, and means for supplying plastic in a fluid condition to the transported upright molds, successively prior to the time they are invented and released so that said plastic will be deposited onto a roadway in said molds and retained in the molds when the molds are inverted and will adhere to the surface of the roadway and set up in place on said roadway and in said molds after said molds are inverted.

9. The machine defined in claim 8 wherein said means for supplying plastic includes a plurality of reservoirs for receiving components of the plastic and means for mixing said components prior to the time that the same are delivered to said molds, said means being carried by said vehicle.

10. The machine defined in claim 9 including means for tamping each mold after the mold has been inverted onto said surface.

11. The machine defined in claim 10 wherein means for tamping the mold includes a roller disposed rearwardly of said conveyor and riding along the surface of said roadway.

12. The apparatus defined in claim 8 including means disposed above said conveyor for spraying a releasing agent into each of said molds, prior to the time that said molds receive said plastic in a fluid condition.

* * * * *